US011361900B2

(12) United States Patent
Fuchs et al.

(10) Patent No.: US 11,361,900 B2
(45) Date of Patent: Jun. 14, 2022

(54) IGNITION COIL

(71) Applicant: Rosenberger Hochfrequenztechnik GmbH & Co. KG, Fridolfing (DE)

(72) Inventors: Martin Fuchs, Freilassing (DE); Steffen Thies, Überackern (AT)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 0 days.

(21) Appl. No.: 17/274,976

(22) PCT Filed: Sep. 9, 2019

(86) PCT No.: PCT/EP2019/073967
§ 371 (c)(1),
(2) Date: Mar. 10, 2021

(87) PCT Pub. No.: WO2020/053134
PCT Pub. Date: Mar. 19, 2020

(65) Prior Publication Data

US 2021/0366651 A1 Nov. 25, 2021

(30) Foreign Application Priority Data

Sep. 14, 2018 (DE) ..... 10 2018 122 467.2

(51) Int. Cl.

| | |
|---|---|
| ***H01F 38/12*** | (2006.01) |
| ***F02P 3/00*** | (2006.01) |
| ***F02P 3/04*** | (2006.01) |
| ***H01F 27/38*** | (2006.01) |

(52) U.S. Cl.
CPC ..... *H01F 38/12* (2013.01); *F02P 3/005* (2013.01); *F02P 3/0407* (2013.01); *H01F 27/38* (2013.01)

(58) Field of Classification Search
CPC ..... F02P 3/01; F02P 3/02; F02P 3/04; F02P 3/005; F02P 3/0407; F02P 23/04; F02P 15/10; F02P 9/007; H01F 38/12; H01F 27/38; H01F 27/40
USPC ..... 123/594–656
See application file for complete search history.

(56) References Cited

U.S. PATENT DOCUMENTS 3,943,905 A * 3/1976 Hartig ..... F02P 3/0884 123/604
5,834,823 A * 11/1998 Honda ..... H01L 29/7302 257/493
8,807,124 B2 * 8/2014 Tanaya ..... F02P 3/0807 123/608

(Continued)

FOREIGN PATENT DOCUMENTS

DE 10 2013 207 909 A1 4/2014
DE 10 2015 210 376 A1 5/2016

*Primary Examiner* — Phutthiwat Wongwian
*Assistant Examiner* — Arnold Castro

(57) ABSTRACT

The present invention relates to an ignition coil for generating a high-voltage pulse with a superimposed high-frequency voltage. The ignition coil comprises a first coil arranged on the primary side, a second coil arranged on the secondary side, a magnetic core and a third coil. The windings of the first coil and of the second coil are wound around the magnetic core. The second coil and the third coil are electrically connected to one another. A high-frequency terminal, which receives the high-frequency voltage, is electrically connected to the second coil and to the third coil.

20 Claims, 7 Drawing Sheets

(56) References Cited

U.S. PATENT DOCUMENTS

Figure 1A:
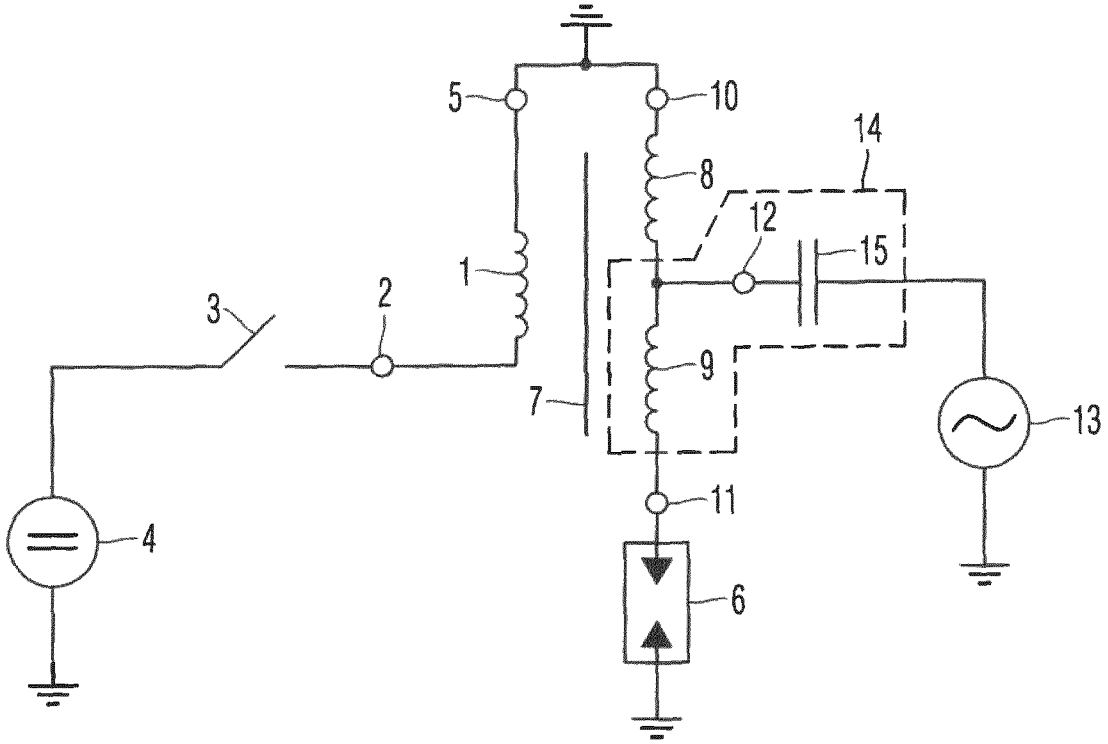

| | | | | |
|---|---|---|---|---|
| 9,765,751 | B2 * | 9/2017 | Tanaya | F02P 3/02 |
| 9,777,695 | B2 | 10/2017 | Itoi et al. | |
| 2005/0126160 | A1 * | 6/2005 | Goldschmidt | C01B 3/342 60/275 |
| 2013/0192571 | A1 * | 8/2013 | Tanaya | F02P 15/10 123/634 |
| 2014/0116405 | A1 | 5/2014 | Tanaya | |
| 2014/0306617 | A1 * | 10/2014 | Tanaya | F02P 15/12 315/223 |
| 2015/0108914 | A1 * | 4/2015 | Muramoto | F02P 9/002 315/209 T |
| 2015/0200051 | A1 * | 7/2015 | Umetani | H01F 27/38 336/178 |
| 2016/0138552 | A1 * | 5/2016 | Itoi | F02P 23/04 315/127 |
| 2021/0359616 | A1 * | 11/2021 | Fuchs | H02M 5/20 |

* cited by examiner

IGNITION COIL

FIELD OF THE INVENTION

The present disclosure relates to an ignition coil for producing a high-voltage pulse with a superimposed high-frequency voltage.

The present disclosure also relates to an arrangement for integrating an ignition coil and a bandpass filter.

The present disclosure also relates to an arrangement for feeding a high-frequency voltage into an ignition coil.

TECHNICAL BACKGROUND

In automobiles, devices for igniting a fuel mixture, in particular a fuel-air mixture are used. The prior art teaches a multiplicity of designs for such devices. In this context, the combustion process in the combustion chamber of the engine, in particular of an internal combustion engine with spark ignition, by means of spark plugs, also known as a gasoline engine, needs to be improved further.

An ignition system or an ignition coil transforms the battery voltage of a vehicle to the desired ignition voltage, in order to provide an ignition signal or an ignition voltage, in particular a high ignition voltage.

From the prior art it is also known to use, as an alternative to producing a pure high ignition voltage, a high-frequency plasma ignition device for igniting a fuel-air mixture, said plasma ignition device generating a high ignition voltage with a superimposed high-frequency voltage.

U.S. Pat. No. 9,777,695 B2 discloses, for example, such a high-frequency plasma ignition device. A high-voltage pulse which is generated in an ignition coil is electrically coupled in said document to a high-frequency voltage which is generated in a high-frequency voltage source.

A bandpass filter is connected between the coupling point and the high-frequency voltage source. This bandpass filter is implemented as a series resonant circuit composed of a coil and a capacitor. The capacitor blocks the DC component of the high-voltage pulse with respect to the high-frequency voltage source. The series resonant circuit is dimensioned in such a way that on the one hand it transmits the high-frequency voltage and, on the other hand, it blocks harmonic portions of the high-voltage pulse and the ignition noise.

The coils and, in particular the high-frequency coils, such as are used for example in a bandpass filter, constitute components which take up a comparatively large amount of space. The space in the engine compartment, in particular in the area above the cylinder bank, is typically not sufficient for this. Spatial separation of the ignition coil and of the bandpass filter in two separate housings additionally requires considerable expenditure in respect of the shaping of the insulation means in the connecting line between the two housings and in the necessary housing connectors with respect to high-voltage strength.

This is a state which needs to be improved.

SUMMARY OF THE INVENTION

Against this background, the present disclosure teaches an ignition coil which is as compact as possible and in which a high-voltage pulse with a superimposed high-frequency voltage is generated.

Inter alia, the present disclosure teaches an ignition coil for generating a high-voltage pulse with a superimposed high-frequency voltage, comprising a first coil arranged on the primary side, a second coil arranged on the secondary side, a magnetic core, and a third coil, wherein windings of the first coil and of the second coil are wound around the magnetic core, wherein the second coil and the third coil are electrically connected to one another, wherein a high-frequency terminal which receives the high-frequency voltage is electrically connected to the second coil and to the third coil.

The teachings of the present disclosure are useful for integrating the coil of the bandpass filter into the ignition coil in a way which is as space-saving as possible.

For this purpose, that coil of the ignition coil which is arranged on the secondary side, referred to below as the second coil, is electrically connected to a further coil, which is referred to below as the third coil and constitutes the coil of the bandpass filter. Furthermore, a high-frequency terminal, which receives a high-frequency voltage, is electrically connected to the second coil and to the third coil. The high-frequency terminal receives a high-frequency voltage from outside the coil, in particular from a high-frequency voltage source which is connected to the high-frequency terminal and which feeds the high-frequency voltage into the ignition coil.

The coils of the ignition coil and of the bandpass filter can therefore be positioned spatially near to one another, and therefore an ignition coil with an integrated coil of a bandpass filter and with a reduced requirement for space can be implemented. Furthermore, this provides an ignition coil in which electrical coupling of a high-voltage pulse, produced on the secondary side in the ignition coil, to a superimposed high-frequency voltage is implemented. The high-voltage pulse which is generated in this way in the ignition coil and has a superimposed high-frequency voltage is electrically extracted from the ignition coil at a terminal of the third coil. This terminal of the third coil is opposite the terminal of the third coil which is connected to the second coil.

The term high-frequency voltage is understood here and in the following to be an AC voltage with a frequency from 100 kHz to 1 GHz, preferably between 1 MHz and 20 MHz. A high-frequency current can alternatively also be fed in at the high-frequency terminal between the second and third coils instead of a high-frequency voltage. In the following, the abbreviation "HF" stands for "high frequency".

If a capacitor is connected and arranged between the HF terminal and the electrical connection between the second coil and third coil, an arrangement is therefore provided in which both the function of the ignition coil and the function of the bandpass filtering are implemented and integrated:

the capacitor and the third coil, which form a series resonant circuit which acts as a bandpass filter, are dimensioned in such a way that the frequency of an HF voltage, which is generated in an HF generator connected to the HF terminal, is in the passband of the bandpass filter. In this way, the HF voltage is additively coupled from the HF generator into the ignition coil.

Moreover, the capacitor and the third coil of the bandpass filter are additionally dimensioned in such a way that ignition noise in the combustion chamber of the internal combustion engine occurs in the higher frequency spectral range of the bandpass filter, that is to say in the stopband of the bandpass filter. The ignition noise is blocked by a correspondingly dimensioned bandpass filter and therefore does not pass from the combustion chamber to the HF generator. The method of functioning of the HF generator is therefore not disrupted by ignition noise.

Harmonic portions of the high-voltage pulse which are generated in the second coil and occur below the cutoff frequency of a high pass filter are damped by suitable dimensioning of the capacitor, which acts as a high-pass filter for the harmonic portions of the high-voltage pulse. Therefore, the harmonic portions of the high-voltage pulse do not pass from the second coil to the HF generator and do not disrupt the method of functioning of the HF generator.

The DC component of the high-voltage pulse is blocked with respect to the HF generator by the capacitor.

The magnetic core is manufactured from a soft-magnetic material with a sufficient magnetic saturation flux density and sufficient permeability. As a result, the magnetic flux which arises when current flows through the electrical conductor of the coil, preferably the coil arranged on the primary side, is concentrated and guided with low loss. The coil which is arranged on the primary side is referred to in the following as the first coil. Moreover, the inductivity of the first coil and of the second coil is increased by the magnetic core. Owing to the high permeability of the coils, the overall size of all the coils, which are wound around the magnetic core on the primary side and secondary side, can become smaller in comparison with an air coil. Therefore, the space required for an ignition coil can be reduced.

Ferromagnetic metal alloys, usually in the form of sheet metal or foil or bound powder, or oxide-ceramic ferrimagnetic materials (ferrites) are used as materials for magnetic cores. In order to reduce eddy currents, which are generated by harmonic portions of the high-voltage pulse and by the HF voltage in the magnetic core, the magnetic core is preferably composed of stacked pieces of sheet metal, between which dielectric layers which are preferably made of paper or plastic are arranged.

The first coil and the second coil are configured with respect to one another in such a way that a sufficient voltage transmission ratio is implemented between the primary circuit and the secondary circuit of the ignition coil. In order to transform a secondary-side high-voltage pulse of typically several 10 kV from a primary-side voltage pulse of typically several 100 V, the number of secondary-side windings is typically higher than the number of primary-side windings by a factor of 10 to 1000. In order to make the volume of the secondary-side coil approximately of the same order of magnitude as the volume of the primary-side coil, the diameter of the electrical conductor of the secondary-side coil is typically smaller, by a factor of 10 to 1000, than the diameter of the electrical conductor which is associated with the primary-side coil.

Advantageous refinements and developments can be found in the further dependent claims and the description with reference to the figures of the drawings.

Of course, the features which are mentioned above and which are to be explained below can be used not only in the respectively specified combination but also in other combinations or alone without departing from the scope of the present invention.

In order to respectively position and orient the first coil, the second coil, the third coil and the magnetic core with respect to one another within the ignition coil, the first coil, the second coil, the third coil and the magnetic core are respectively connected to one another by means of a spacer element composed of an electrically insulating material.

For example a spacer, a plastic film or a coil former, around which the coil is wound, can serve as a spacer element. In this context, the individual spacer elements are respectively embodied between the first coil, the second coil, the third coil and the magnetic core in such a way that the ignition coil has the smallest possible design and at the same time the effects between the first coil, the second coil, the third coil and the magnetic core are as small as possible.

Between the first coil, the second coil, the third coil and the magnetic core as well as the spacer elements arranged between them there is typically a cured sealing compound made of a dielectric material, for example artificial resin, preferably a casting resin. The sealing compound serves both to secure the individual coils and the magnetic core to one another as well as to provide electrical insulation, in particular to increase the high-voltage strength, between the individual coils.

In a first embodiment of an ignition coil, the third coil is magnetically coupled on the secondary side to the magnetic flux which is guided by the magnetic core. The third coil is for this purpose wound with its individual windings on the secondary side around the magnetic core. Therefore, the secondary side of the ignition coil is formed by the serial connection of the second and third coils. The high-voltage pulse is therefore generated both in the second coil and in the third coil. The serial connection of the second and third coils can also be considered to be a single coil with two coil areas. In the junction between the two coil areas of such a coil, an electrical contact terminal, referred to as a central terminal, is accordingly provided, said terminal being electrically connected to the HF terminal.

The advantage of the first embodiment is the compact design of the ignition coil, since no additional space is required for the positioning of the third coil next to the installation space of the ignition coil. In the first embodiment, the third coil therefore performs a double technical function. It serves to perform bandpass filtering and to generate the high-voltage pulse.

In the first embodiment, the third coil may be optimized with respect to its HF transmission characteristic as a component of the bandpass filter within the HF path in that the distances between respective successive windings of the third coil are increased in comparison with respective successive windings of the second coil. The parasitic capacitances within the third coil are therefore reduced in comparison with the customary parasitic capacitances of the second coil.

A further technical measure for reducing the parasitic capacitances within the third coil and therefore for improving the HF transmission behavior of the third coil is possible by using a winding of the third coil which is optimized for HF transmission.

As an alternative to or in addition to the reduction in the parasitic capacitances, in the third coil the wire diameter of the third coil is made larger than the wire diameter of the second coil as a further technical measure for improving the HF transmission characteristic. An HF current, which is impressed by the HF voltage, flows only on the surface of the coil. A larger cross-sectional area occurs for the HF current, at a given frequency-dependent penetration depth of said current, in the third coil than in the second coil. Therefore, the ohmic resistance which is relevant for the HF current is reduced in the surface region of the conductor of the third coil in comparison with the conductor of the second coil. This effect improves the quality of the third coil which is embodied as an HF coil, and therefore the HF transmission characteristic of the third coil. The HF current will therefore flow in an amplified fashion through the third coil and in a reduced fashion through the second coil. Undesired electrical coupling of the HF voltage or of the HF current into the second coil is reduced in this way.

Therefore, inductive coupling of the HF voltage or of the HF current occurs from the secondary side to the primary side of the ignition coil, mainly from the third coil to the first coil. When there is a relatively large distance between the individual windings of the third coil, it is possible to implement a relatively small number of windings in the third coil and therefore a relatively low inductance for the third coil, which causes lower inductive coupling between the third coil and the first coil.

In some embodiments, the third coil is coated, with its impedance being lower than the impedance of the basic material. Since the HF current which is driven by the HF voltage flows on the surface of the third coil, and therefore primarily in the region of the coating of the third coil, the HF current will flow essentially through the third coil and not through the second coil, which does not have a coating with a relatively low impedance. Silver, copper, gold, tin, aluminum, tungsten, molybdenum, titanium, zirconium, niobium, tantalum, bismuth, palladium and lead are suitable as the coating material. Alloy or composite materials made of one or more of these materials are also suitable.

In an ignition coil, the primary-side coil and the secondary-side coil or coils are wound together around a main limb of a magnetic core. In order to implement a closed iron path for the magnetic flux, the magnetic core has at least one return limb and two yokes which respectively connect the main limb and the return limb. The magnetic core which is composed of the main limb, the return limb and the two yokes surrounds both the primary-side and the secondary-side coil or coils here. In some embodiments of the ignition coil as a shell-type transformer, the magnetic core has a main limb, two return limbs and two yokes which respectively connect the main limb and the two return limbs to one another. A magnetic partial flux is therefore respectively guided via the main limb, a return limb and two partial regions of the two yokes.

The primary-side coil and the secondary-side coil or coils are wound concentrically with respect to one another around the main limb. The second and third coils preferably surround the first coil. However, it is alternatively also possible for the first coil to surround the second and third coils. Spacer elements are respectively provided between the magnetic core, the first coil and the second and third coils in order to provide electrical insulation.

In some embodiments, the third coil surrounds the second coil and the first coil. In this context, the second coil preferably surrounds the first coil. Alternatively, the first coil can also surround the second coil.

In order to reduce the magnetic coupling between the third coil, the first coil and the second coil, a foil made of an easily magnetizable material, preferably made of a Mu metal, is arranged between the third coil and the second coil. Alternatively, it is also possible to provide a copper foil in which eddy currents are excited by the HF current flowing in the third coil, and the electromagnetic field between the third coil and the second coil or the first coil is therefore damped. In order to provide electrical insulation, a foil made of a dielectric material is respectively arranged between the foil made of magnetizable material, or the copper foil, and the third coil and the second coil.

In a second embodiment of the ignition coil, the third coil is embodied as an HF coil. According to the prior art, HF coils are wound around a magnetic core made of a ferrite. Since ferrites typically do not have high heat resistance, they are not very suitable for application in the surroundings of a motor with temperatures around 100° C. For this reason, the third coil which is embodied as an HF coil is preferably embodied as what is referred to as an air coil, i.e. as a coil without a magnetic core.

Consequently, in the second embodiment of the ignition coil the third coil is positioned and oriented within the ignition coil in such a way that it does not surround the magnetic core and as a result, on the other hand, the entire ignition coil remains as compact as possible. In addition, in the case of the arrangement of the third coil in the second embodiment of the ignition coil it is to be considered that the lowest possible magnetic coupling between the third coil and the first and second coils is possible. Moreover, as a result of the HF feed into the third coil the lowest possible HF losses, in particular eddy current losses in the adjoining magnetic core, are to be aimed at.

It is expedient here for the individual windings of the third coil which are implemented as an air coil to be respectively positioned at a lateral distance from an end face of the magnetic core. The term end face of the magnetic core is understood to mean the lateral face of the magnetic core whose surface vector runs respectively parallel to the longitudinal direction of the magnetic core, i.e. to the longitudinal direction of the feedthrough/feedthroughs of the magnetic core. Moreover, the cross-sectional face of the third coil is oriented parallel to the end face of the magnetic core. The term cross-sectional face of the third coil is understood to be the cross-sectional face of the third coil whose surface vector runs parallel to the longitudinal direction of the third coil, e.g. to the longitudinal direction of the feedthrough of the third coils.

Finally, the third coil encloses, with its windings, at least one region of the first coil and/or of the second coil.

Since the third coil surrounds, with its windings, at least one region of the first coil and/or of the second coil, specifically the region of the first coil and/or of the second coil which projects out of the magnetic core and at the same time said third coil is positioned at a lateral distance from the end face of the magnetic core, the third coil takes up, with its windings, the still free space to the side of the magnetic core, which is not occupied by the first coil and/or the second coil. Therefore, the first subvariant of the second embodiment of the ignition coil implements a space-saving way of integrating the third coil into the ignition coil.

Since the cross-sectional face of the third coil is oriented parallel to the end face of the magnetic core, the magnetic fields of a third coil run largely orthogonally with respect to the magnetic fields of the first and second coils, said fields being concentrated and guided as magnetic flux in the magnetic core. In this way, a further advantage is that the magnetic coupling between the third coil and the first and/or second coils is minimized.

In this context, the total inductivity of the third coil can be doubled if a third coil is positioned to the side of each of the two end faces of the magnetic core, said third coils being connected to one another in series. The serial connection of a plurality of third coils therefore provides a possibility of increasing the inductivity of the bandpass filter and therefore reducing the capacitance of the bandpass filter. With a relatively low capacitance of the capacitor it is possible to implement a high level of damping of the harmonic portions of the high-voltage pulse by means of the capacitor which also acts as a high-pass filter.

In a second subvariant of the second embodiment of the ignition coil, the individual windings of the third coil which is implemented as an air coil are respectively positioned at a lateral distance from an end face of the magnetic core. The third coil is at a lateral distance here, with its windings, from one of the two return limbs or from one of the two yokes. Moreover, the cross-sectional face of the third coil is oriented perpendicularly with respect to the end face of the magnetic core.

As a result of the positioning of the third coil at a lateral distance from an end face of the magnetic core, in particular at a lateral distance from one of the two return limbs or from one of the two yokes, the third coil therefore takes up the space which is still free to the side of the magnetic core and which is not occupied by the first coil and/or the second coil. A compact design is therefore implemented.

The magnetic coupling between the third coil and the first and second coils is reduced, since with the exception of the junction region between the main limb and the two yokes the magnetic field of the third coil is oriented orthogonally with respect to the magnetic fields of the first and second coils. Since the junction region between the main limb and the two yokes is comparatively small and is not at the maximum of the magnetic field lines of the third coil, the magnetic coupling between the third coil and the first and second coils is low.

It is therefore particularly expedient if a plurality of third coils which are connected to one another in a serial fashion are positioned at a lateral distance from an end face of the magnetic core. The cross-sectional area of all the third coils which are connected in series are respectively oriented perpendicularly with respect to the end face of the magnetic core.

Since a third coil can be respectively positioned at a lateral distance from each other to the two return limbs and from each other to the two yokes of the magnetic core and from each other to the two end faces of the magnetic core, up to eight third coils can therefore be connected in series. In comparison with a single third coil, the serial connection of a plurality of third coils results in an increase in the total inductivity. Since, owing to the smaller cross-sectional face and therefore lower number of windings of the third coil according to the second subvariant, said third coil has lower inductivity than the third coil according to the first subvariant, the serial connection of a plurality of third coils according to the second subvariant can compensate for this disadvantage and, under certain circumstances, can even be improved in comparison with the first subvariant.

In a third subvariant of the second embodiment of the ignition coil, the third coil is positioned at a lateral distance from the lateral face of the first and/or second coil.

Moreover, the cross-sectional face of the third coil is oriented perpendicularly with respect to the end face of the magnetic core. Although the ignition coil is less compact, it has lower eddy current losses in the magnetic core, i.e. lower HF losses, owing to the larger distance between the third coil and the magnetic core. The magnetic coupling between the third coil and the first and second coils is also reduced, since the distance between the third coil and the magnetic core is larger in comparison.

It has proven particularly advantageous if a further coil is connected between the HF terminal and the second coil, said further coil being embodied as an HF coil preferably as an inductor. This further coil is referred to as a fourth coil in the following.

An HF coil, in particular an inductor, damps an HF voltage as well as possible and at the same time minimizes the eddy currents produced in the magnetic core by the HF voltage.

In order to damp the HF voltage, an inductor has an inductive resistance, i.e. an impedance with a significantly higher inductive portion in comparison with the capacitive portion. The damping within the inductor is to be configured as a function of the cross-sectional face, the number of windings and the coil length of the inductor. In order to reduce HF losses, the inductor is preferably embodied as an air coil. The damping of the HF voltage reduces electrical coupling of the HF voltage, impressed at the HF terminal, into the second coil. This advantageous effect occurs more clearly when parasitic capacitances are present between the secondary side of the ignition coil and the housing of the ignition coil which is typically manufactured from an electrically conductive material.

The fourth coil can, like the third coil, be positioned at a lateral distance from an end face of the magnetic core. The cross-sectional face of the fourth coil can be oriented, like the third coil, parallel or perpendicularly with respect to the end face of the magnetic core. A series connection of a plurality of fourth coils in order to increase the inductivity is also conceivable.

The coupling of the HF voltage into the ignition coil can be reduced by connecting an ohmic resistance between the second coil and the HF terminal. This ohmic resistance damps, given suitable dimensioning, the HF voltage in the direction of the ignition coil. The ohmic resistance additionally damps the spark plug current which is driven by the HF pulse. A relatively high frequency interference current, which is caused by the ignition process, is superimposed on this spark plug current which causes the fuel-air mixture in the combustion chamber to ignite. The relatively high frequency interference current which is superimposed in the spark plug current is extracted from the spark plug as EMC interference and irradiated via the feedline of the spark plug. Since the level of relatively high frequency interference current is dependent on the level of the spark plug current, the damping of the spark plug current can effectively decrease the EMC irradiation by means of the ohmic resistance.

Finally, there is a third embodiment of an ignition coil in which the third coil is spaced apart at a lateral distance from the first and second coils, and the cross-sectional face of the third coil is preferably oriented perpendicularly with respect to an end face of the magnetic core. In addition, the third coil is arranged in a connecting shaft within an engine block. In this way, the overall volume of the ignition coil outside the engine block is restricted to the first coil, the second coil and the magnetic core, thereby reducing the space required for the ignition coil considerably.

A connecting shaft within an engine block is understood to be a recess running from the outer surface of the engine block in the internal area of the engine block. This recess has a suitable cross-sectional profile, for example a round cross-sectional profile, and a specific longitudinal extent. The longitudinal extent of the connecting shaft can run in a linear, curved or bent fashion. The connecting shaft permits an electrical connecting element to be routed between a spark plug, mounted in the internal area of the engine block, and an ignition coil, the latter being typically positioned outside the engine block, or inside the engine block, directly adjacent to the outer surface of the engine block.

As a result of the preferably perpendicular orientation of the cross-sectional face of the third coil with respect to an end face of the magnetic core, the magnetic field of the third coil runs orthogonally with respect to the magnetic fields of the first and second coils which are associated with the ignition coil. The magnetic coupling between the third coil and the first or second coil is therefore reduced.

Since a third coil with a high number of windings can be positioned within the connecting shaft, a third coil with a high inductivity can be implemented by means of the third embodiment.

The above refinements and developments can, where appropriate, be combined in any desired way. Further possible refinements, developments and implementations of the invention also comprise combinations which have not been explicitly specified for features of the invention which are described above and below with respect to the exemplary embodiments. In particular, in this context a person skilled in the art will also add individual aspects as improvements or additions to the respective basic form of the present invention.

CONTENTS OF THE DRAWINGS

Figure 1B:
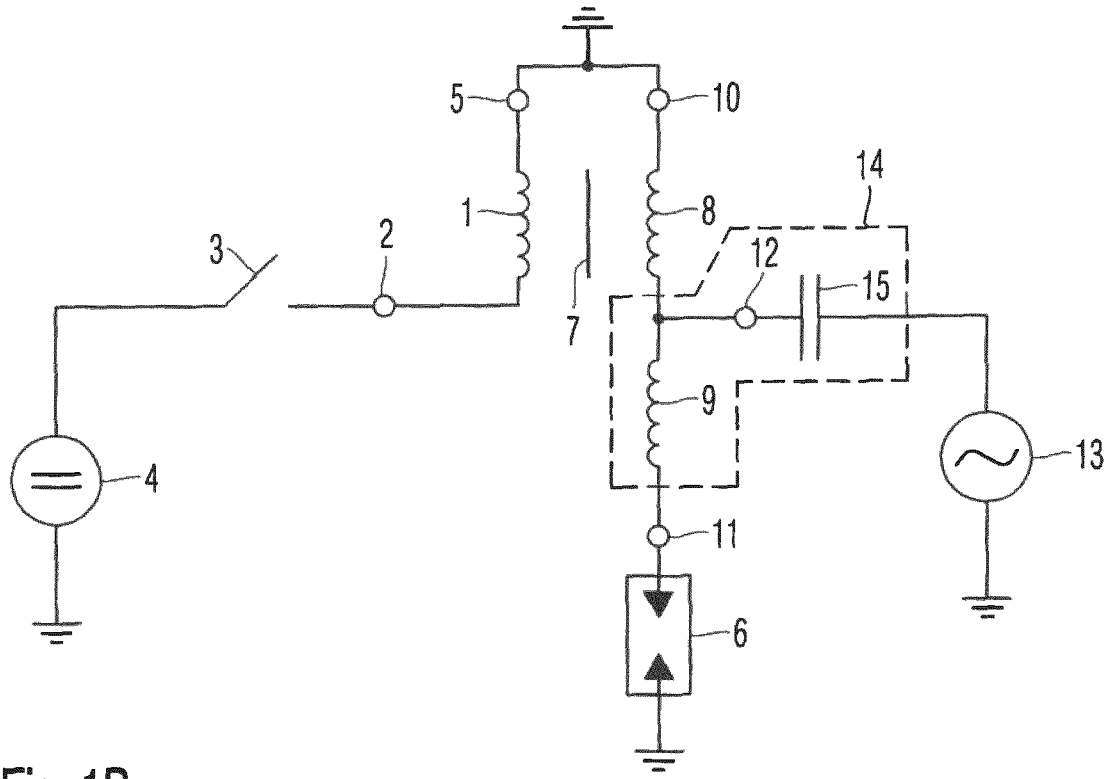
Figure 2A:
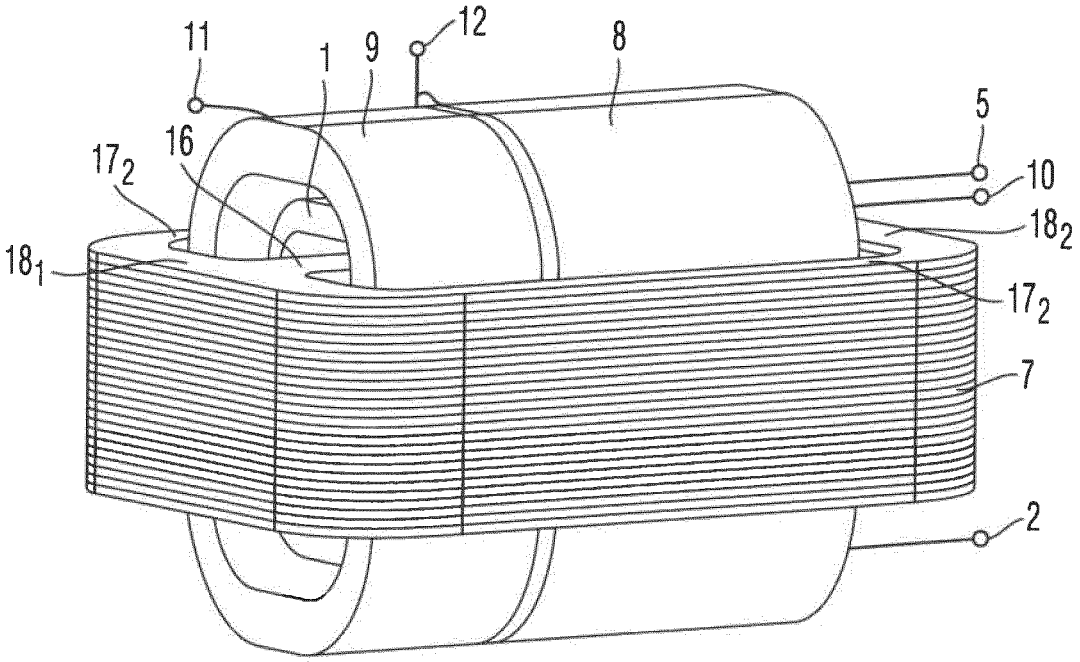
Figure 2B:
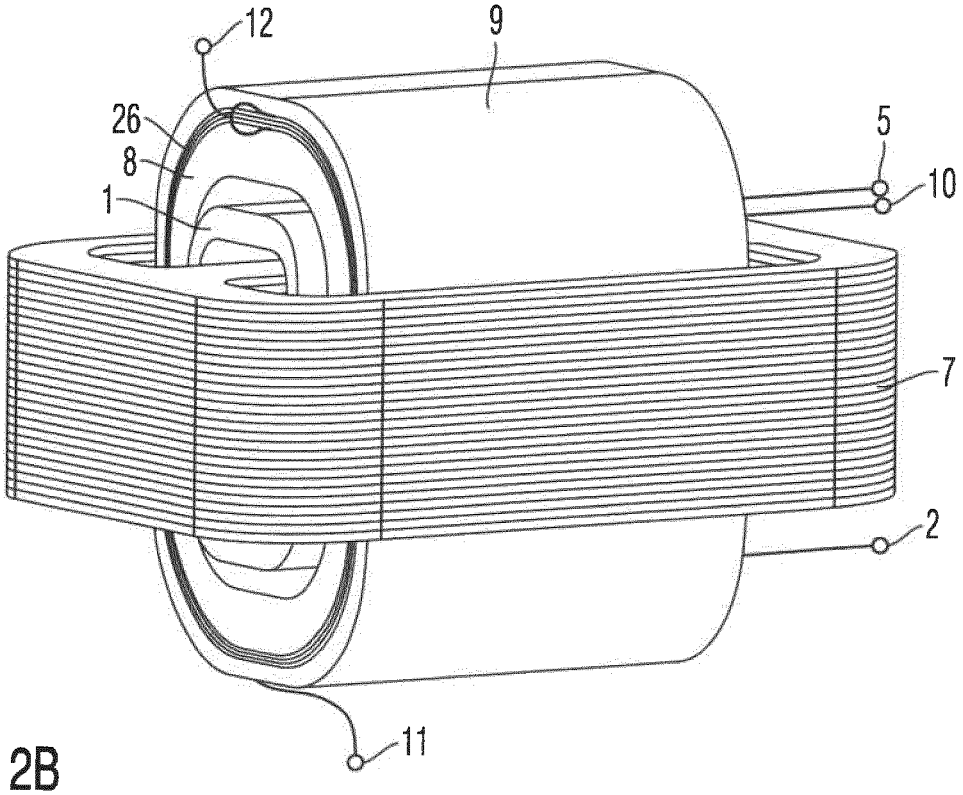
Figure 2C:
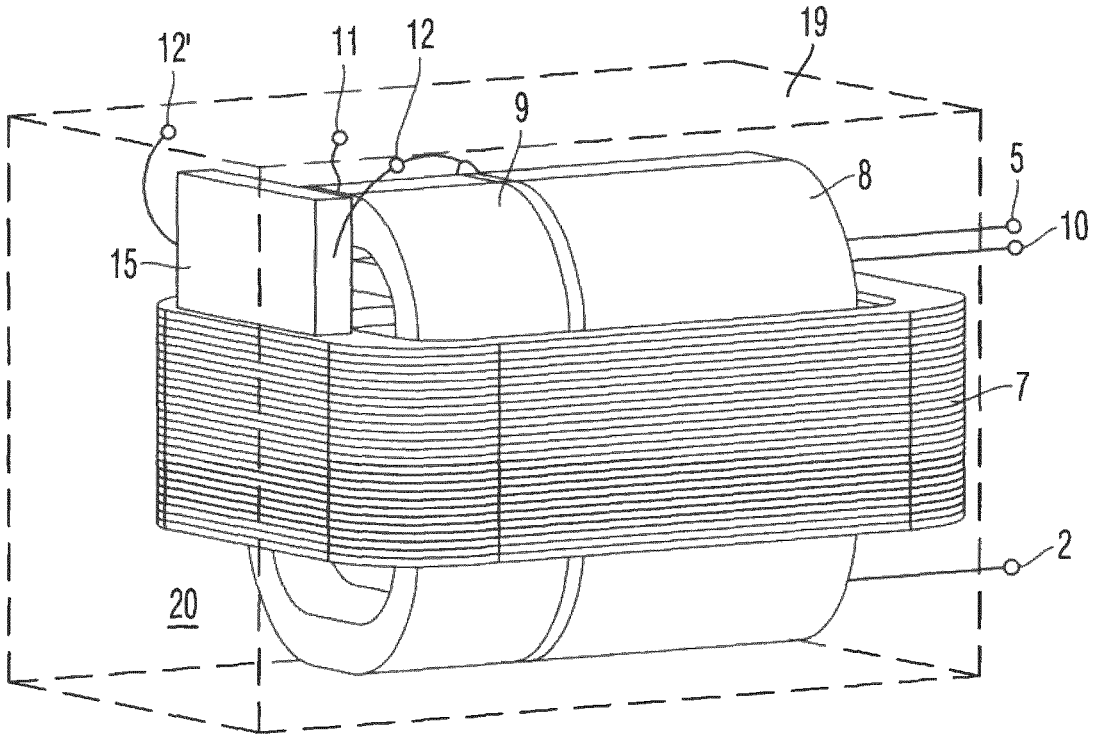
Figure 3A:
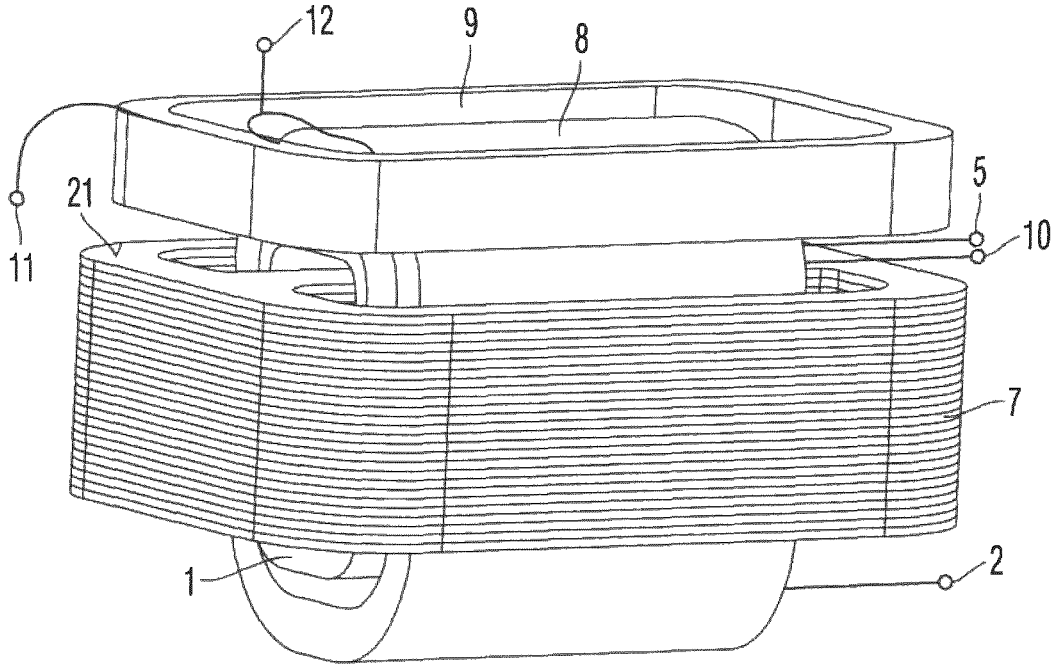
Figure 3B:
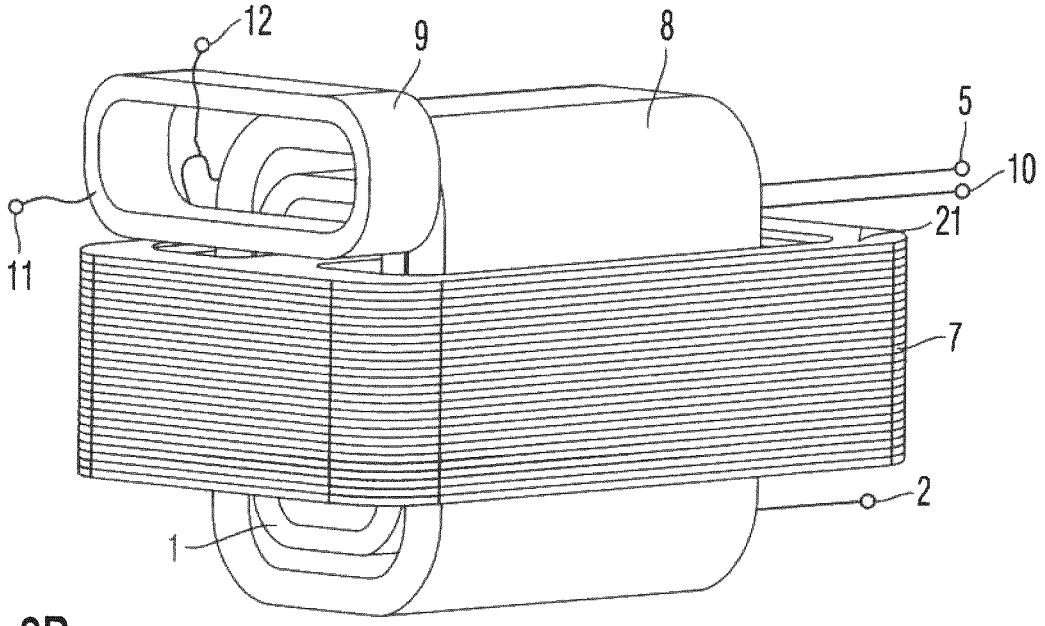
Figure 3C:
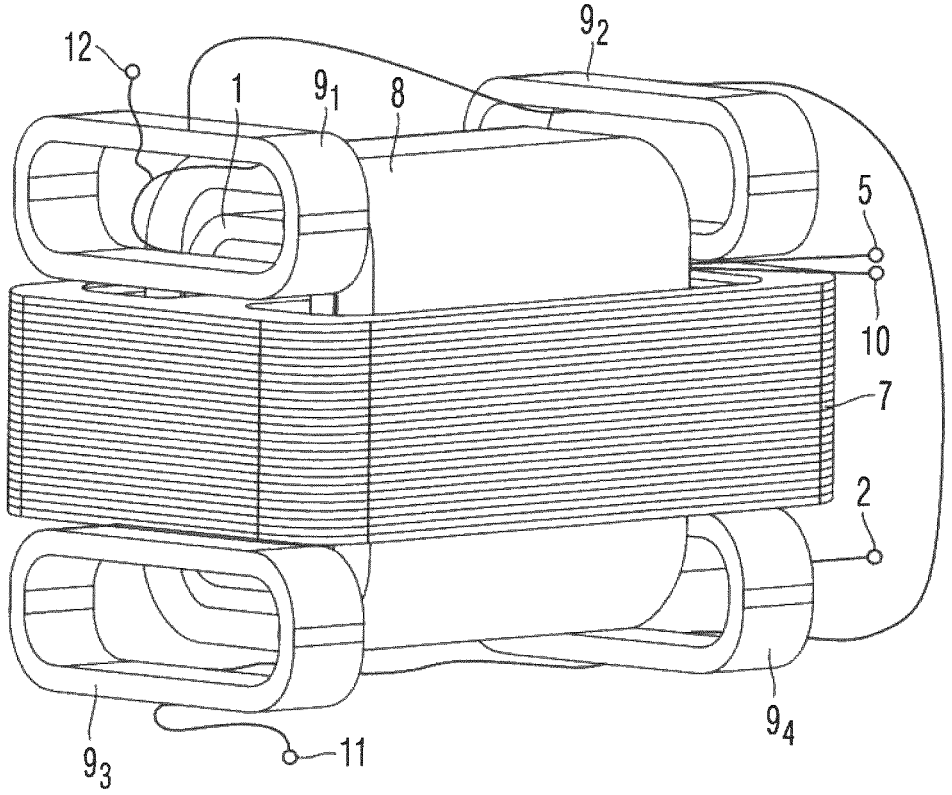
Figure 3D:
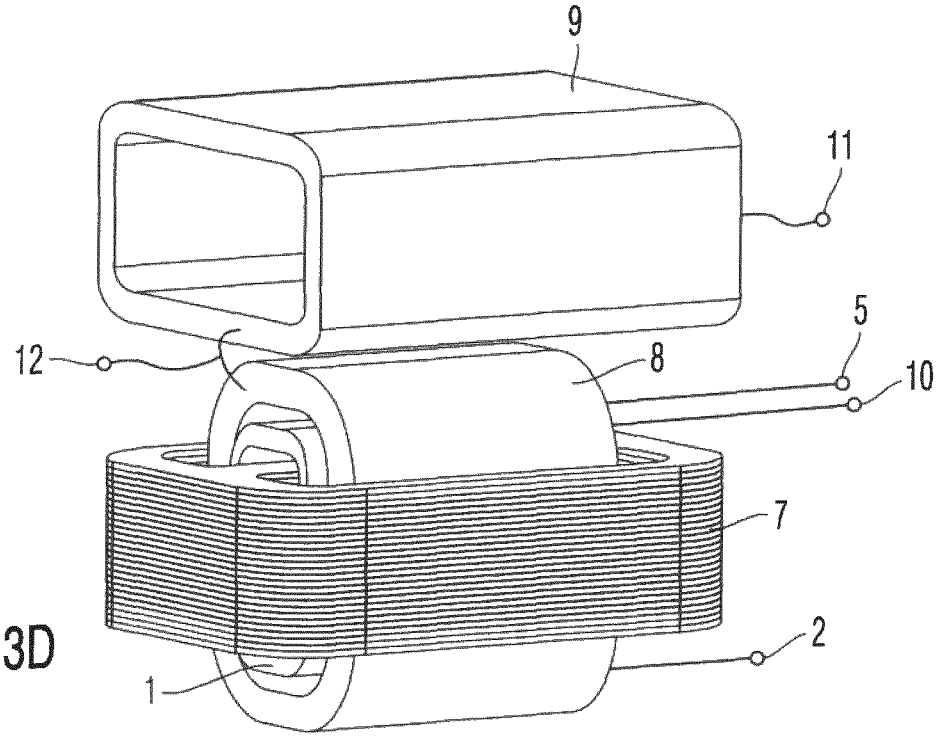
Figure 4A:
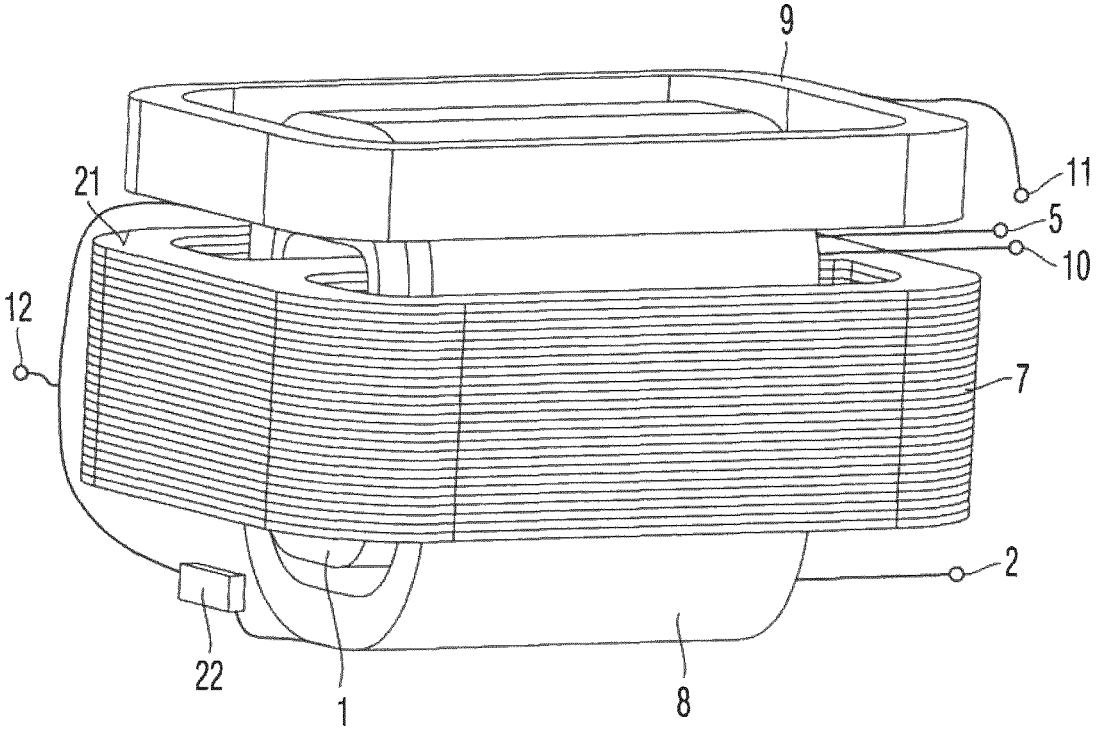
Figure 4B:
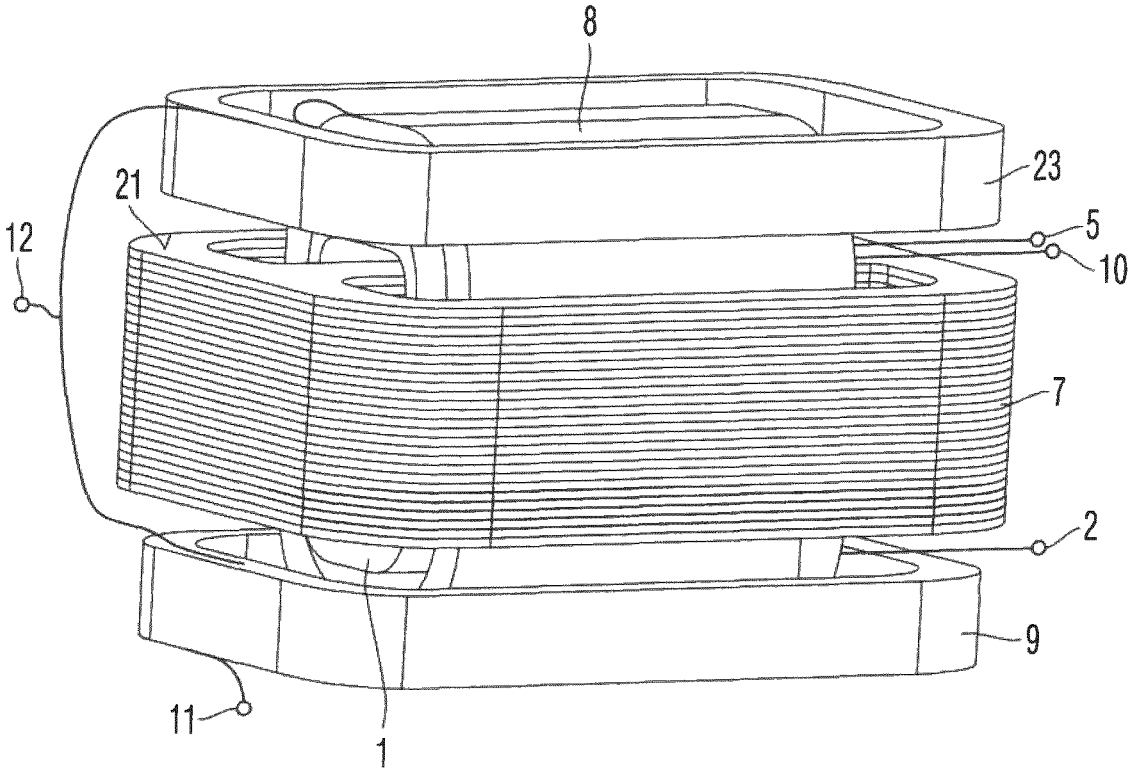
Figure 4C:
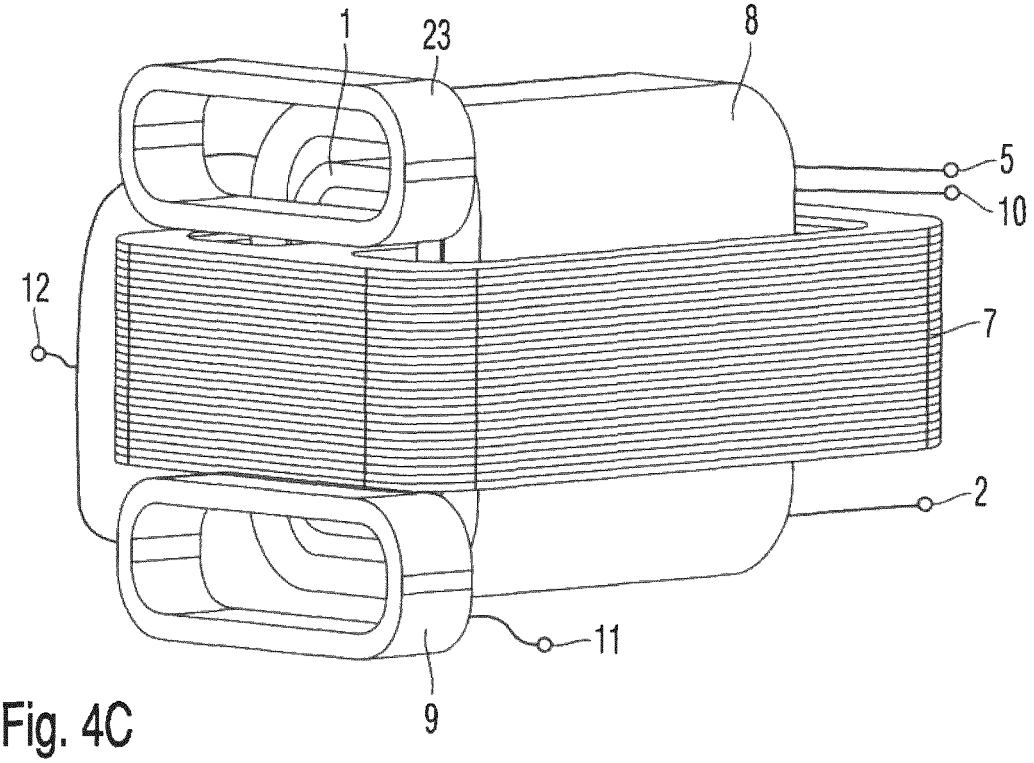
Figure 5:
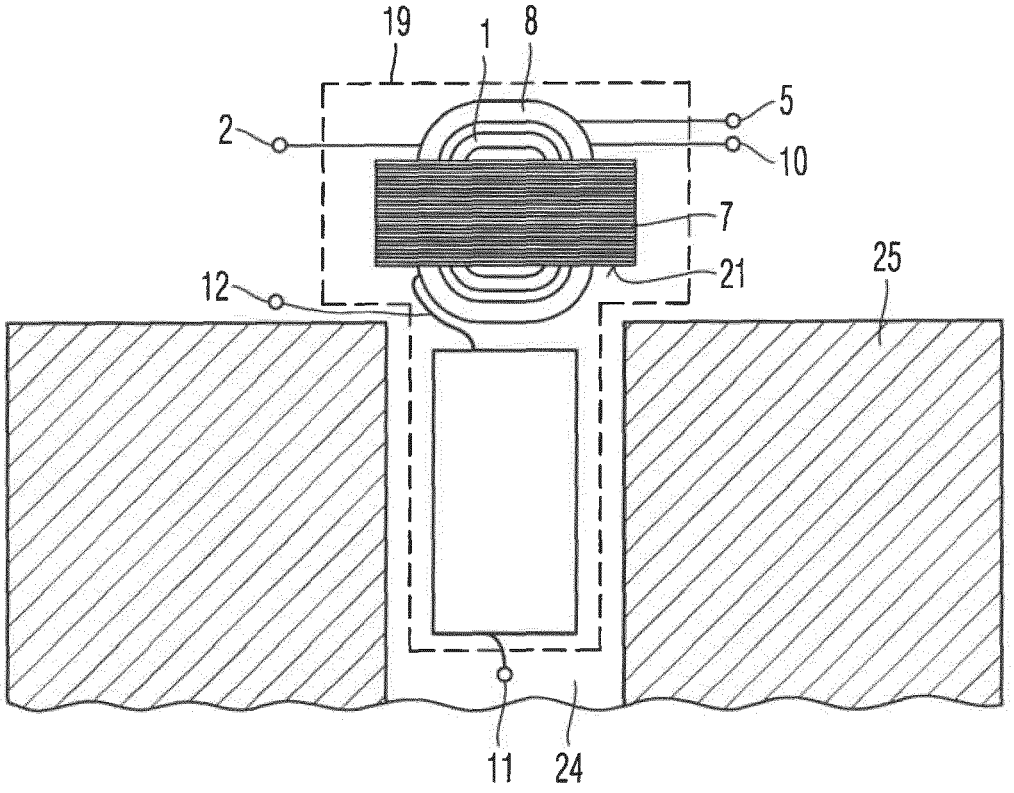

The present invention will also be explained in more detail on the basis of the exemplary embodiments disclosed in the schematic figures of the drawings. In the drawings:

FIG. 1A shows a circuit diagram of a first embodiment of the ignition coil,

FIG. 1B shows a circuit diagram of a second embodiment of the ignition coil, FIG. 2A shows a three-dimensional illustration of the first embodiment of the ignition coil, FIG. 2B shows a three-dimensional illustration of a further implementation of the first embodiment of the ignition coil, FIG. 2C shows a three-dimensional illustration of an arrangement which is integrated in a housing and is composed of an ignition coil and a bandpass filter, FIG. 3A shows a three-dimensional illustration of a first subvariant of the second embodiment of the ignition coil, FIG. 3B shows a three-dimensional illustration of a second subvariant of the second embodiment of the ignition coil, FIG. 3C shows a three-dimensional illustration of an extension of the second subvariant of the second embodiment of the ignition coil, FIG. 3D shows a three-dimensional illustration of a third subvariant of the second embodiment of the ignition coil, FIG. 4A shows a three-dimensional illustration of an ignition coil with a first implementation for minimizing the electrical coupling of the HF voltage into the primary side of the ignition coil, FIG. 4B shows a three-dimensional illustration of an ignition coil with a second implementation for minimizing the electrical coupling of the HF voltage into the primary side of the ignition coil, FIG. 4C shows a three-dimensional illustration of an ignition coil with a third implementation for minimizing the electrical coupling of the HF voltage into the primary side of the ignition coil, and FIG. 5 shows a cross-sectional illustration of an engine block with an integrated ignition coil.

The appended figures of the drawings are intended to impart further understanding of the disclosed embodiments. They illustrate embodiments and serve, in conjunction with the description, to clarify principles and concepts of the invention. Other embodiments and many of the specified advantages become apparent by considering the drawings. The elements of the drawings are not necessarily shown true to scale with respect to one another.

In the figures of the drawings, identical, functionally identical and identically acting elements, features and components are respectively provided with the same reference numbers unless stated otherwise.

In the text which follows, the figures are described coherently and comprehensively.

DESCRIPTION OF EXEMPLARY EMBODIMENTS

Before the geometric arrangement of the individual components in an ignition coil is explained in detail with reference to FIGS. 2A, 2B, 3A, 3B, 3C, 3D, 4A, 4B, 4C and 5, the electrical connection of the individual components of an ignition coil and an arrangement for integrating an ignition coil and a bandpass filter according to the present disclosure will be presented in the following with reference to the circuit diagrams in FIGS. 1A and 1B:

In the circuit diagram in FIG. 1A, an arrangement for integrating a first embodiment of an ignition coil according to the present disclosure with a bandpass filter is illustrated:

The first coil 1 is connected at one end to the electrode of a DC voltage source 4, preferably a battery, via a DC voltage terminal 2 of the ignition coil, a switch 3. The other electrode of the DC voltage source 3 is connected to a ground potential. The further electrode of the first coil 1 is also connected to a ground potential via a ground terminal 5 of the ignition coil. In the phase before the ignition of the spark plug 6, which is connected to the ignition coil, the switch 3 is closed. A DC current, which is driven by the DC voltage of the DC voltage source 5, flows through the first coil 1 of the ignition coil.

In order to fire the spark plug 5, the switch 3 is opened, and therefore the flow of current through the first coil 1 is interrupted. This interruption of the flow of current induces a voltage pulse in the first coil 1. The voltage level of the voltage pulse is dependent on the inductivity of the first coil 1 and the change in current in the first coil 1, and therefore indirectly on the voltage level of the DC voltage source 4. The voltage level of the voltage pulse is therefore in the order of magnitude of several 100 V and is therefore not sufficient for igniting the fuel/air mixture within the combustion chamber by means of the spark plug 6. In order to amplify the voltage pulse induced in the first coil 1, a transformer with a magnetic core 7 is provided in the ignition coil, around which transformer the windings of the first coil 1 are wound on the primary side, and the windings of a second coil 8 and of a and of a third coil 9 are wound on the secondary side.

If the number of windings in the two coils which are arranged on the secondary side is a multiple of the number of windings in the coil which is arranged on the primary side, the voltage pulse which is induced in the first coil 1 is transformed into a high-voltage pulse in the two coils which are arranged on the secondary side. In order to generate a secondary-side high-voltage pulse of several 10 kV from the primary-side voltage pulse of the level of several 100 V, a ratio between the windings of the first coil 1 and the windings of the second coil 8 and the third coil 9 is to be typically provided between 10 windings and several 100 windings.

The embodiment of the magnetic core 7 and the arrangement of the first coil 1, the second coil 8 and the third coil 9 will be explained in more detail below.

The one end of the second coil 8 and the one end of the third coil 9 are electrically connected to one another. The other end of the second coil 8 is connected to a ground potential by a further ground terminal 10 of the ignition coil.

The other end of the third coil 9 is electrically connected to an electrode of the spark plug 6 via a high-voltage terminal 11 of the ignition coil. The other electrode of the spark plug 6 is connected to the ground potential.

In order to generate a high-voltage pulse with a superimposed HF voltage, an HF terminal 12 which is associated with the ignition coil and has the purpose of feeding in an HF voltage is electrically connected to the second coil 8 and the third coil 9. This HF voltage is superimposed additively on the high-voltage pulse which is transformed into the second coil 8 and into the third coil 9. Instead of an HF voltage, an HF current can also be impressed or fed in at the HF terminal 12. The HF voltage is generated in an HF voltage source 13.

In order to form a bandpass filter 14, which is implemented as a series resonant circuit composed of a coil and a capacitor, a capacitor 15 is connected between the HF source 13 and the HF terminal 12. The third coil 9 serves as a coil of the series resonant circuit and/or of the bandpass filter 15.

The capacitor 15 serves at the same time as a high-pass filter. Its capacitance is dimensioned in such a way that the harmonic portions of the high-voltage pulse generated in the second coil 8 occur in the low-frequency stopband of the high pass filter, and are therefore blocked before the HF voltage source 13. Finally, the capacitor 15 also blocks the DC portion of the high-voltage pulse which is generated in the second coil 8. In the second parameterization step, the inductivity of the third coil 9 is configured in such a way that, in combination with the capacitance of the capacitor 15 which is defined in the first parameterization step, a resonance frequency of the series resonant circuit, and therefore a central frequency of the bandpass filter 14, is present at which the frequency of the generated HF voltage occurs. In this way the bandpass filter 14 is transmissive for the generated HF voltage, while it has a blocking effect for the relatively high-frequency ignition noise.

With the ignition coil according to FIG. 1A, an ignition coil is therefore provided which generates a high-voltage pulse with a superimposed HF voltage, and at the same time integrates the coil of the bandpass filter with low expenditure. In the first embodiment of an ignition coil according to the present disclosure, illustrated in FIG. 1A, the coil of the bandpass filter is implemented as part of the secondary-side winding of an ignition coil. The secondary-side winding of the ignition coil is therefore composed of the serial connection of the second coil 8 and the third coil 9. The present disclosure also covers the alternative case in which the secondary-side winding of the ignition coil is implemented as a single coil which is arranged on the secondary side and comprises two coil regions which are connected to one another in a serial fashion. In this context, a so-called central contact or central terminal for feeding in the HF voltage is provided in the connecting region between the two coil regions. The integration of the coil of the bandpass filter into the secondary-side winding of the ignition coil advantageously also brings about a reduction in the overall volume of the arrangement composed of the ignition coil and bandpass filter.

In a second embodiment of the ignition coil according to the present disclosure, the third coil 9 is located outside the magnetic core 7 of the ignition coil. Only the windings of the first coil 1 and of the second coil 8 are wound around the magnetic core 7. The magnetic flux is guided and concentrated in the magnetic core 7 between the first coil 1 arranged on the primary side and the second coil 8 arranged on the secondary side. A large part of the inductive coupling is therefore implemented only between the first coil 1 and the second coil 8. In the second embodiment of the ignition coil, the third coil 9 is instead arranged in the direct vicinity of the magnetic core 7 and of the first and second coils 1 and 8. The inductive coupling between the first coil 1 and the third coil 9 is therefore significantly reduced in comparison with the first embodiment. The inductive coupling between the first coil 1 and the third coil 9 is carried out here only by means of the flux leakage.

The second embodiment of the ignition coil does not differ from the first embodiment in other details. A repeated description of the features and components which are identical to those in the first embodiment is therefore not given at this point.

FIG. 2A presents an arrangement of a first embodiment of the ignition coil:

The magnetic core 7 is constructed here from layered pieces of sheet metal, between each of which layers of electrically insulating material are arranged. The layered pieces of sheet metal are manufactured from a soft-magnetic material, preferably from iron. Eddy currents in the longitudinal direction of the magnetic core 7 are prevented by the layering of the pieces of sheet metal.

The magnetic core 7 is composed of a main limb 16, two return limbs $\mathbf{17}_1$ and $\mathbf{17}_2$ and two yokes $\mathbf{18}_1$ and $\mathbf{18}_2$, which connect the two return limbs $\mathbf{17}_1$ and $\mathbf{17}_2$ to the main limb 16. The windings of the first coil 1, of the second coil 8 and of the third coil 9 are wound around the main limb 16. The windings of the first coil 1, of the second coil 8 and of the third coil 9 are therefore each guided through two feedthroughs in the magnetic core 7 which are respectively arranged between the main limb 16, one of the two return limbs $\mathbf{17}_1$ and $\mathbf{17}_2$ and in each case one region of the two yokes $\mathbf{18}_1$ and $\mathbf{18}_2$ in the longitudinal direction of the magnetic core 7.

In addition to this embodiment of the ignition coil, which is also referred to as a shell-type transformer, an embodiment of the ignition coil is also conceivable in which the magnetic core 7 only has a single return limb. However, a greater degree of compactness of the ignition coil is implemented in this embodiment at the cost of higher flux leakage. The implementation of the ignition coil as a core-type transformer with two main limbs and two yokes connecting the two main limbs to one another is also conceivable. The windings of the first coil 1 are wound around the one main limb here, and the windings of the second and third coils 8 and 9 are wound around the other main limb. However, more compact winding of the windings which are arranged on the primary side and the windings which are arranged on the secondary side, around the associated main limb, and therefore a shorter longitudinal extent of the ignition coil requires a greater transverse extent of the ignition coil here owing to the provision of two main limbs.

As illustrated in FIG. 2A, the windings of the first coil 1 preferably surround the main limb 16, firstly adjacent to the main limb 16, while the windings of the second and third coils 8 and 9 surround the windings of the first coil 1. The windings of the second and of the third coils 8 and 9 are arranged adjacent to one another in the direction of their longitudinal extent in the first implementation illustrated in FIG. 2A. The transverse extent of the second and third coils 8 and 9 and therefore also the transverse extent of the ignition coil are minimized in this implementation.

The first coil 1, the second coil 8 and the third coil 9 are each wound around a winding body made of an electrically insulating material, not illustrated in FIG. 2A for reasons of clarity. Each of the winding bodies respectively serves as a spacer element between the magnetic core 7, the first coil 1, the second coil 8 and the third coil 9. The individual winding bodies are preferably connected to one another. In this way, the magnetic core 7, the first coil 1, the second coil 8 and the third coil 9 can be respectively positioned and oriented with respect to one another. In particular, an arrangement with minimized intermediate distances and therefore minimized installation space is possible with such winding bodies and all spacer elements.

FIG. 2A shows the electrical connection between the second coil 8 and the third coil 9, which connection is connected to the HF terminal 12. The two ground terminals 5 and 10 of the first coil 1, and respectively the second coil 8, the DC voltage terminal 2 connected to the first coil 1 and the high-voltage terminal 11 connected to the output of the third coil 9 can be seen in FIG. 2A.

According to FIG. 2C, the ignition coil is preferably arranged in a housing 19. This housing 19, indicated by dashed lines in FIG. 2C, is preferably manufactured from electrically conductive material, for example aluminum, in order to achieve a good electromagnetic shielding effect. In this way, the HF voltage which is coupled into the ignition coil does not penetrate the exterior space of the housing 19, and therefore does not have a negative effect on or cause the disruption of electronics which are arranged in the engine compartment of a vehicle. On the other hand, as a result of the shielding housing, HF electronics which are arranged in the engine compartment of a vehicle do not have adverse effects on the high-voltage pulse which is generated in the ignition coil and on the control electronics (not illustrated in FIG. 2C) of the ignition coil.

The capacitor 15 is integrated into the housing 19 of the ignition coil, and therefore the bandpass filter 14 is completely integrated with it. This gives rise to a compact design of an arrangement for integrating an ignition coil and bandpass filter. In order to bring about particularly space-saving positioning within the housing 19, the capacitor 15 is, as indicated in FIG. 2C, arranged in a space, not yet occupied, within the housing 19, at a lateral distance from an end face of the magnetic core 7. Alternatively, the capacitor 15 can, however, also be arranged outside the housing 19.

All the terminals of the ignition coil are, as indicated in FIG. 2C, led out of the housing 19. Respective suitable connectors, preferably housing connectors can preferably be formed for the individual terminals of the ignition coil. In this context it is to be noted that the HF terminal 12 of the ignition coil, which terminal is electrically connected to the second coil 8 and to the third coil 9, is moved to the other terminal of the capacitor 15, owing to the integration of the capacitor 15 into the housing 19, and said HF terminal 12 is therefore led out of the housing 19 as HF terminal 12'.

When the ignition coil is mounted in the housing 19, a liquid sealing compound 20 composed of electrically insulating material, preferably a casting resin 20, particularly preferably polyurethane, is introduced between the housing 19 and the ignition coil and its intermediate spaces. After the curing of the sealing compound 20, the intermediate space between the housing 19 and the ignition coil is completely filled with the cured sealing compound 20. In this way, the high-voltage strength of the ignition coil between its individual components—magnetic core 7, first coil 1, second coil 8 and third coil 9—and also between the individual components of the ignition coil and the electrically conductive housing 19 is additionally increased. Moreover, the spacing between the third coil 9 which is embodied as an HF coil and the electrically conductive housing 19 and between the third coil 9 and the typically grounded magnetic core 7 is to be configured by means of the sealing compound 20 in such a way that the parasitic capacitances of the third coil 9 are at a relatively low level. The high-voltage strength of the third coil 9 which is embodied as an HF coil can be additionally improved by not only the insulation but also by the sealing compound 20 by means of an insulated HF coil, for example by means of an HF coil which is manufactured with an enameled copper wire. The first coil 1 and the second coil 8 can also be wound with an enameled copper wire in order to increase the high-voltage strength.

In a second implementation of the first embodiment of the ignition coil according to FIG. 2B, the third coil 9 is not arranged, when viewed in the direction of its longitudinal extent, adjacent to the second coil 8 but rather surrounds the second coil 8. The third coil 9 is therefore arranged, when viewed in the direction of its transverse extent, adjacent to the second coil 8. The third coil 9 can be wound here onto a winding body. In order to reduce the magnetic coupling between the third coil 9 and the first coil 1 as well as the second coil 8, a foil 26 made of an easily magnetizable material, preferably made of a Mu metal, is arranged between the third coil 9 and the second coil 8. Alternatively, it is also possible to arrange a copper foil in which eddy currents are excited by the HF current flowing in the third coil 9, and therefore the electromagnetic field between the third coil 9 and the second coil 8 or the first coil 1 is damped. In order to provide electrical insulation, a foil made of a dielectric material, preferably made of a plastic, in particular made of polyurethane, is respectively arranged between the foil 26 made of magnetizable material or the copper foil, and the third coil 9 as well as the second coil 8.

In the first implementation of the first embodiment of an ignition coil according to FIG. 2A it is also possible to respectively arrange, for the sake of a more compact design, a dielectric plastic film, instead of winding bodies, between the first coil 1 and the second coil 8 or the third coil 9.

In both implementations of the first embodiment of an ignition coil according to FIGS. 2A and 2B, the third coil 9 can be configured like the second coil 8 in respect of its transmission characteristic, in particular its HF transmission characteristic. However, since an HF current which is driven by the applied HF voltage is to flow through the third coil 9 in as optimum a way as possible, while electrical coupling of the HF current into the second coil 8 is to be minimized as far as possible, high-frequency technical optimization of the third coil 9 is to be aimed at, as is presented below:

In a first technical measure, for this purpose the distances between respective successive windings of the third coil 9 are configured to be larger than the distances between respective successive windings of the second coil 8. The parasitic capacitances, which occur, in particular, between two successive windings, in the third coil 9 are therefore minimized in comparison with the second coil 8, and in this way the HF transmission characteristic of the third coil 9 is optimized in comparison with the second coil 8.

In a second technical measure, the parasitic capacitances in the third coil 9 are minimized by a particular way of winding the electrical conductor. The third coil 9 is wound, for example, to form a honeycomb coil, a basket coil, star coil or flat coil. In this way, the HF transmission behavior of the third coil 9 can be optimized in comparison with the second coil 8. An additional improvement of the HF transmission behavior for the third coil 9 is achieved by the winding of an HF braded conductor as an electrical conductor for the third coil 9.

In a third technical measure, the wire diameter, i.e. the diameter of the electrical conductor, of the third coil 9 is configured to be larger than the wire diameter of the second coil 8. The HF current flows only on the surface of the electrical conductor of a coil owing to the skin effect, and said current penetrates, starting from the surface of the electrical conductor, only as far as a specific penetration depth, which depends inter alia on the frequency of the HF current and on material parameters of the electrical conductor, into the electrical conductor of the coil. Therefore, in the case of an electrical conductor with a relatively large diameter and an identical penetration depth, the cross-sectional area of the electrical conductor of the coil in which the HF current flows is larger owing to the relatively large circumference than in an electrical conductor with a relatively small diameter. The electrical impedance of the third coil 9, which acts on the HF current, is therefore smaller than in the case of the second coil 8, by virtue of the second technical measure. The HF transmission characteristic is therefore improved in the third coil 9 in comparison with the second coil 8.

In a fourth technical measure, the third coil 9 is coated, while the second coil 8 remains without a coating. The coating of the third coil 9 has a lower electrical impedance than the basic material of the third coil 9. Therefore, the coating is manufactured from a coating material which has a higher electrical conductivity and/or lower permeability than the basic material. The HF current, which flows in the surface region of the electrical conductor of the coil owing to the skin effect, consequently experiences a better HF transmission characteristic in the third coil 9 than in the second coil 8.

At this point is to be noted that the inductivity of the basic material of the second coil 2 is larger by a multiple than the total inductivity of the basic material and coating material of the third coil 9, with the result that the HF current preferably flows through the third coil 9 owing to the significantly higher impedance of the second coil 8.

In the second embodiment of an ignition coil, which is presented in the following with reference to FIGS. 3A, 3B, 3C and 3D, the third coil 9 does not have a magnetic core and is therefore implemented as an air coil. In a suitably selected orientation of the third coil 9 with respect to the magnetic core 7, it is possible to significantly minimize the magnetic and inductive coupling between the third coil 9 and the first coil 1 by means of the magnetic flux which is guided and concentrated in the magnetic core 7. Magnetic and inductive coupling to the first coil 1 is implemented only via the flux leakage which occurs in a significantly weaker form. In contrast to the first embodiment of an ignition coil, the magnetic and inductive coupling of the HF voltage from the secondary side into the primary side of the ignition coil is significantly minimized.

In the first subvariant of the second embodiment of an ignition coil according to FIG. 3A, the third coil 9 which is embodied as an air coil is positioned at a lateral distance from an end face 21 of the magnetic core 7. Moreover, the third coil 9 surrounds, with its windings, at least one region of the first coil 1 and of the third coil 8, which region corresponds to the region, projecting out of the magnetic core 7, of the first coil 1 and of the third coil 8.

Therefore, the third coil 9 takes up the still unused space to the side of the magnetic core 7, which space is not used by the first coil 1 and the second coil 8. However, in order to achieve a compact design of the ignition coil, the third coil 9 is positioned near to the magnetic core 7 and at the first and second coils 1 and 8. In this way, a compact design is implemented for the ignition coil. Of course, in the arrangement of an ignition coil illustrated in FIG. 3A, the third coil 9 can be arranged not only above the magnetic core 7 but also below the magnetic core 7.

Finally, the cross-sectional face of the third coil 9 is oriented parallel to the end face 21 of the magnetic core 7. As a result of this orientation of the third coil 9 with respect to the magnetic core 7, the magnetic field of the third coil 9 runs orthogonally with respect to the direction of the magnetic flux of the first and second coils 1 and 8 within the magnetic core 7. Only in the junction region between the main limb and the two yokes of the magnetic core 7 is the orthogonality in the orientation of the magnetic field of the third coil 9 with respect to the magnetic flux within the magnetic core 7 not given to a slight extent. However, since this junction region is very small and is not located at the maximum of the magnetic field strength of the third coil, magnetic and inductive coupling between the third coil 9 and the two other coils of the ignition coil, in particular the first coil 1, is minimized as far as possible.

In a second subvariant of the second embodiment of an ignition coil, the third coil 9 is also positioned at a lateral distance from an end face 21 of the magnetic core 7. The third coil 9 is arranged here laterally adjacent either to one of the two yokes or to one of the two return limbs of the magnetic core 7. Therefore, in the second subvariant, the third coil 9 also takes up the still unused space to the side of the magnetic core 7, which space is not used by the first coil 1 and the second coil 8. In this case a compact design for the ignition coil is also achieved.

In the second subvariant, the cross-sectional face of the third coil 9 is positioned perpendicularly with respect to an end face 21 of the magnetic core 7. In the second subvariant, the magnetic field of the third coil 9 is also oriented within the magnetic core 7 orthogonally with respect to the direction of the magnetic flux of the first and second coils 1 and 8, which is guided in the magnetic core 7. Only in the junction region between the main limb and the two yokes of the magnetic core 7 is the orthogonality between the magnetic field of the third coil 9 and the magnetic flux, guided in the magnetic core, of the first and second coils 1 and 8 not given to a slight extent. Since the coil length is typically greater than the wire diameter of the third coil 9, the orthogonality between the magnetic field of the third coil 9 and the magnetic flux, guided in the magnetic core, of the first and second coils 1 and 8 in the junction region between the main limb and the two yokes of the magnetic core 7 is implemented to a slightly less well in the second subvariant than in the first subvariant. However, since the junction region is also comparatively very small here and is not located at the maximum of the magnetic field strength of the third coil 9, the magnetic coupling between the third coil 9 and the first and second coils 1 and 8 is also reduced in the second subvariant of the second embodiment.

In the second subvariant, the third coil 9 has a lower cross-sectional face than in the first subvariant, and therefore has a lower inductivity. As has already been mentioned above, for the configuration of the bandpass filter 14, a comparatively high inductivity is necessary for the third coil 9 at a given frequency of HF voltage and in the case of a comparatively low capacitance of the capacitor 15.

For this purpose, in an extension of the second subvariant of the second embodiment of an ignition coil according to FIG. 3C, a plurality of third coils $\mathbf{9}_1$, $\mathbf{9}_2$, $\mathbf{9}_3$ and $\mathbf{9}_4$ are connected in series. With each third coil which is additionally connected in series the total inductivity of such a serial connection of third coils is increased by the inductivity of a single third coil.

Since a third coil 9 can be respectively positioned at a lateral distance at each yoke and at each return limb of the magnetic core 7 and at each of the two end faces 21 of the magnetic core 7, up to eight third coils can be positioned and connected in the ignition coil. In this way, the total inductivity of such a serial connection of third coils can be multiplied by a factor of eight in comparison with the inductivity of a single third coil.

In the first subvariant, the inductivity of the third coil 9 can also be doubled if a third coil is respectively positioned at a lateral distance from the two end faces 21 of the magnetic core 7, and the two third coils are connected in series with respect to one another.

In a third subvariant of the second embodiment of an ignition coil according to FIG. 3D, the third coil 9 is positioned to the side of the lateral face of the first coil 1 and of the second coil 8, preferably to the side of the lateral face of the second coil 8 which is arranged on the outside. Owing to the lateral positioning of the third coil 9 with respect to the first and second coil 1 and 8, the design of the ignition coil in the third subvariant of the second embodiment is degraded to a certain extent over all the subvariants and embodiments presented until now. However, in the third subvariant, owing to the greater distance between the third coil 9 and the magnetic core 7 it is possible to implement lower eddy current losses in the magnetic core 7, i.e. lower HF losses of the third coil 9 through which an HF current flows, at the cost of the smaller degree of compactness of the ignition coil. The magnetic and inductive coupling between the third coil 9 and the two coils of the ignition coil, in particular the first coil 1, is also reduced owing to the larger distance between the third coil 9 and the magnetic core 7. Finally, in the third subvariant it is possible to implement a greater degree of inductivity for the third coil 9, since free spaces are provided for lengthening the third coil 9 and for increasing the size of the cross-sectional face of the third coil 9.

In addition to the minimizing of the magnetic coupling between the third coil 9 and the two other coils of the ignition coil, in particular the first coil 1, the electrical coupling of the HF voltage from the HF terminal 12 into the second coil 8 is to be additionally minimized. The minimization of the electrical coupling of the HF voltage from the HF terminal 12 into the second coil 8 is explained in detail in the following with reference to FIGS. 4A to 4C:

in a first variant for minimizing the electrical coupling of the HF voltage from the HF terminal 12 into the second coil 8 according to FIG. 4A, an ohmic resistor 22 is connected between the HF terminal 12 and the second coil 8. In order to achieve a design for the ignition coil which is compact as possible, the ohmic resistor 22 is preferably to be positioned to the side of one of the two end faces 21 of the magnetic core 7, in a space which is not yet used by the first coil 1, the second coil 8 or the third coil 9.

The ohmic resistor 22 is dimensioned in such a way that an HF current which is driven by the HF voltage at the HF terminal 12 is damped in such a way that only a comparatively low HF current flows through the second coil 8. The ohmic resistor 22 is, moreover, to be dimensioned in relation to the ohmic resistor within the second coil 8 in such a way that the HF voltage level at the junction between the second coil 8 and the ohmic resistor 22 is significantly lower than at the HF terminal 12.

The ohmic resistor 22 also damps, as an additional positive effect, spark plug current which is driven by the high-voltage pulse. A relatively high-frequency interference current, which is caused by the ignition process, is superimposed on this spark plug current which brings about ignition of fuel/air mixture in the combustion chamber. The relatively high-frequency interference current which is superimposed in the spark plug current is disadvantageously output from the spark plug as EMC interference and irradiated in the feedline of the spark plug. Since the level of the relatively high-frequency interference current is dependent on the level of the spark plug current, the EMC irradiation can be effectively reduced by the damping of the spark plug current by means of the ohmic resistor 22.

In a second variant for minimizing the electrical coupling of the HF voltage from the HF terminal 12 into the second coil 8 according to FIG. 4B, a further coil 23, which is referred to in the following as the fourth coil 23, is connected between the HF terminal 12 and the second coil 8. This fourth coil 23 is embodied as an HF coil and is therefore implemented as an air coil in view of minimizing the HF losses. The fourth coil 23 is preferably embodied as an inductor and damps, with its inductive impedance, the HF voltage fed in at the HF terminal 12. At the junction between the fourth coil 23 and the second coil 8 there is consequently an HF voltage level which is reduced in comparison with the voltage level of the HF voltage at the HF terminal 12.

With a view to achieving a compact design of the ignition coil, the fourth coil 23 which is implemented as an air coil is positioned, in a way analogous to the third coil 9 in the first subvariant of the second embodiment of an ignition coil, at a lateral distance from an end face 21 of the magnetic core 7 and surrounds the region, projecting out of the magnetic core 7, of the first coil 1 and of the second coil 8. According to FIG. 4B, the third coil 9 and the fourth coil 23 are each positioned at a lateral distance from two different end faces 21 of the magnetic core 7, with the result that an ignition coil with the highest possible degree of compactness is implemented.

The cross-sectional face of the fourth coil 23 is oriented, in a way analogous to the cross-sectional face of the third coil 9, parallel to an end face 21 of the magnetic core 7. In this way, the magnetic field both of the third coil 9 and of the fourth coil 23 are respectively oriented orthogonally with respect to the direction of the magnetic flux of the first coil 1 and of the second coil 8 within the magnetic core 7. The magnetic and inductive coupling of the third coil 9 and also of the fourth coil 23 with respect to the first coil 1 and with respect to the second coil 8 is therefore reduced.

According to FIG. 4C the fourth coil 23 can be positioned, in a way analogous to the third coil in the second subvariant of the second embodiment of an ignition coil, at a lateral distance from an end face 21 of the magnetic core 7 and at the same time can be oriented with its cross-sectional face perpendicularly with respect to an end face 21 of the magnetic core 7. The third coil 9 and the fourth coil 23 can, according to FIG. 4C, each be positioned at a lateral distance from two different end faces 21 of the magnetic core 7.

In a way analogous to the extension of the second subvariant of the second embodiment of an ignition coil, it is possible, with a view to increasing the inductivity of the fourth coil 23, to connect a plurality of fourth coils 23 in series and to arrange them in a space-optimized fashion within the ignition coil.

In a third embodiment of an ignition coil which is illustrated in FIG. 5, the third coil 9 is arranged in the connecting shaft 24 of an engine block 25 with a view to achieving a compact design. The third coil 9 is positioned here to the side of the lateral face of the first coil 1 and of the second coil 8, preferably to the side of the lateral face of the second coil 8 which is arranged on the outside.

The cross-sectional face of the third coil 9 is oriented here parallel to an end face 21 of the magnetic core 7. In this way, the magnetic field of the third coil 9 is oriented orthogonally with respect to the magnetic flux of the first coil 1 and of the second coil 8, which magnetic flux is guided in the magnetic core 7. Therefore, the magnetic and inductive coupling between the third coil 9 and the first coil 1 is minimized with the exception of the coupling by the flux leakage.

The housing 19 of the ignition coil, which is indicated by dashed lines in FIG. 5, is configured in such a way that it contains all the components of the ignition coil and can be introduced into the connecting shaft 24 of the engine block 25.

Although the present invention has been described completely above on the basis of preferred exemplary embodiments, it is not limited thereto but rather can be modified in a variety of ways.

LIST OF REFERENCE NUMERALS

1 first coil
2 DC voltage terminal
3 switch
4 DC voltage source
5 ground terminal
6 spark plug
7 magnetic core
8 second coil
9 third coil
$\mathbf{9}_1$, $\mathbf{9}_2$, $\mathbf{9}_3$, $\mathbf{9}_4$ third coil
10 mass terminal
11 high-voltage terminal
12,12' high-frequency terminal
13 high-frequency voltage source
14 bandpass filter
15 capacitor
16 main limb
$\mathbf{17}_1$, $\mathbf{17}_2$ return limb
$\mathbf{18}_1$, $\mathbf{18}_2$ yoke
19 housing
20 sealing compound
21 end face
22 ohmic resistor
23 fourth coil
24 connecting shaft
25 engine block
26 foil

The invention claimed is:

1. An ignition coil, comprising:
a ground terminal;
an output terminal;
a first coil;
a second coil;
a third coil; and
a capacitor, wherein
said second coil is electromagnetically coupled with said first coil,
a first end of said second coil is electrically conductively connected to said ground terminal,
a second end of said second coil is electrically conductively connected to a first end of said third coil,
a second end of said third coil is electrically conductively connected to said output terminal,
a first contact of said capacitor is electrically conductively connected to said second end of said second coil, and
said first contact is electrically conductively connected to said second end of said third coil.

2. The ignition coil of claim 1, comprising:
an input terminal, wherein
a first end of said first coil is electrically conductively connected to said ground terminal, and
a second end of said first coil is electrically conductively connected to said input terminal.

3. The ignition coil of claim 1, wherein:
said third coil is electromagnetically coupled with said first coil.

4. The ignition coil of claim 1, wherein:
said third coil is substantially orthogonal to said first coil and said second coil.

5. The ignition coil of claim 1, wherein:
an electromagnetic coupling of said third coil to said first coil is substantially less than an electromagnetic coupling of said second coil to said first coil.

6. The ignition coil of claim 1, wherein:
said first coil comprises a first number of windings, and
said second coil comprises a second number of windings that is at least 10 times said first number of windings.

7. The ignition coil of claim 1, comprising:
a magnetic core, wherein
said first coil comprises first windings wound around said magnetic core, and
said second coil comprises second windings wound around said magnetic core.

8. The ignition coil of claim 7, wherein:
said third coil comprises third windings wound around said magnetic core.

9. The ignition coil of claim 7, comprising:
a housing; and
a dielectric resin inside said housing, wherein
said dielectric resin encases said magnetic core, said first coil, said second coil, said third coil and said capacitor.

10. The ignition coil of claim 7, wherein:
at least part of said third coil is situated within an imaginary, minimally-sized rectangular parallelepiped cuboid enclosing said magnetic core, said first coil, and said second coil.

11. A system, comprising:
a magnetic core;
a first, primary-side coil;
a second, secondary-side coil;
a third coil; and
a capacitor, wherein
said first coil comprises first windings wound around said magnetic core,
said second coil comprises second windings wound around said magnetic core,
said second coil and said third coil constitute at least part of a first electrical path from a first node to a second node,
a first contact of said capacitor is connected to said first electrical path at a common node intermediate said second coil and said third coil, and
said capacitor does not constitute part of said first electrical path.

12. The system of claim 11, wherein:
said capacitor and said third coil constitute at least part of a second electrical path from a second contact of said capacitor to said second node.

13. The system of claim 11, comprising:
a spark plug that constitutes at least part of a third electrical path from said second node to ground.

14. The system of claim 11, comprising:

a high-frequency signal generator that generates an AC signal having a frequency greater than 100 kHz, wherein an output node of said high-frequency signal generator is connected to a second contact of said capacitor.

15. The system of claim 11, comprising:

a spark plug; and a high-frequency signal generator, wherein said high-frequency signal generator generates an AC signal having a frequency greater than 100 kHz, and said high-frequency signal generator, said capacitor, said third coil, and said spark plug are connected in series.

16. The system of claim 15, wherein:

said spark plug and said first electrical path are connected in series.

17. The system of claim 11, comprising:

a DC voltage source; and a switch, wherein said DC voltage source, said switch, and said first coil are connected in series.

18. The system of claim 11, comprising:

a dielectric resin that encases said magnetic core, said first coil, said second coil, said third coil and said capacitor.

19. The system of claim 11, wherein:

at least part of said third coil is situated within an imaginary, minimally-sized rectangular parallelepiped cuboid enclosing said magnetic core, said first coil, and said second coil.

20. A method, comprising:

energizing a magnetic core using a flow of DC current through a first coil at least partially wound around said magnetic core, creating a voltage pulse in a second coil at least partially wound around said magnetic core by ceasing said flow of DC current, superimposing an AC signal onto said voltage pulse using a bandpass filter, and feeding said voltage pulse superimposed with said AC signal to a spark plug, wherein said spark plug comprises a first electrode and a second electrode, said bandpass filter comprises a third coil and a capacitor, said second coil, said third coil, said first electrode, and said second electrode are connected in series, and said capacitor, said third coil, said first electrode, and said second electrode are connected in series.

* * * * *